United States Patent [19]

Borel

[11] Patent Number: 5,002,447

[45] Date of Patent: Mar. 26, 1991

[54] PROCESS FOR PRODUCING A BINDING WITH STATIONARY POCKETS AND BINDING OBTAINED BY THIS PROCESS

[75] Inventor: Pierre Borel, St. Martin D'Heres, France

[73] Assignee: Jowa, S.A., Sassenage, France

[21] Appl. No.: 201,724

[22] Filed: Jun. 3, 1988

[30] Foreign Application Priority Data

Jun. 15, 1987 [FR] France ..... 87 08751

[51] Int. Cl.[5] ..... B42B 5/00

[52] U.S. Cl. ..... 412/6; 281/15.1; 281/21.1; 281/29; 281/35; 412/4; 412/20; 412/33

[58] Field of Search ..... 281/15.1, 24, 35, 21.1; 412/1, 2, 3, 4, 6, 33, 20

[56] References Cited

U.S. PATENT DOCUMENTS

| | | | |
|---|---|---|---|
| 2,390,125 | 12/1945 | Schade | 281/29 |
| 3,206,225 | 9/1965 | Oleson | 412/3 |
| 3,884,742 | 5/1975 | Roberts | 412/1 X |
| 4,377,430 | 3/1983 | Bexley et al. | 412/3 X |
| 4,830,404 | 5/1989 | Lu | 281/29 |
| 4,844,508 | 7/1989 | Choi | 281/51 X |

*Primary Examiner*—Paul A. Bell

*Attorney, Agent, or Firm*—Browdy & Neimark

[57] ABSTRACT

A binding provided with stationary transparent pockets which can receive sheets of any type of materials, such as sheets of paper, cardboard, photographs, samples of floor or wall coverings, and the like. The cover of the binding comprises a transparent double sheet of the same material as the pockets. This sheet is heat-sealed together with pockets in the zone of folding, while two cardboard sheets are glued to the inside of the double sheet in the zone comprising two flat surfaces.

4 Claims, 1 Drawing Sheet

PROCESS FOR PRODUCING A BINDING WITH STATIONARY POCKETS AND BINDING OBTAINED BY THIS PROCESS

FIELD OF THE INVENTION

This invention relates to a books with stationary transparent pockets which can receive sheets of any materials, such as sheets of paper, cardboard, photographs, samples of flooring or wall coverings, etc.

BACKGROUND OF THE INVENTION

Known books of this type are made up of a thick one-piece cover of polypropylène or PVC, for example, in whose inside folding the transparent pockets are heat-sealed.

A drawback of these known books is that it is difficult with this type of covering to personalize at least one face of the book (generally it is desired to personalize the front side of the book). It is indeed possible to print on polypropylene, but printing on polypropylene is difficult and it is expensive. Further, these printings often hold up poorly. A solution currently in use comprises attaching to the polypropylene cover a transparent pocket which can receive a label, drawing or a photograph. This label holder has the drawback of being unesthetic, easily, torn and the label, drawing or photograph is imperfectly held.

SUMMARY OF THE INVENTION

The present invention aims at remedying these drawbacks. It comprises making a book with stationary transparent pockets starting from a transparent double sheet which has the dimensions of two flats and of the back of the cover and which is of a plastic identical with that of the transparent pockets to be bound, gluing first of all a rigid or semirigid sheet (paper, cardboard, photograph...) to the back of at least one of the halves of this double sheet in the zone which can constitute respectively, one of the two flats of the books, and, leaving a free space at the location of the center folding. Then, after optionally having glued another plastic sheet of the same dimension and of the same material to the other side of these two rigid or semirigid sheets, the transparent pockets are heat-sealed together with the center zone of the folding of the cover thus formed. Making the pockets solid by heat-sealing is performed after having folded this cover on the stack of pockets.

BRIEF DESCRIPTION OF THE DRAWINGS

The invention will be better understood, and its advantages and other characteristics will come out during the following description of three non-limiting embodiments, with reference to the accompanying diagrammatic drawings, in which.

DETAILED DESCRIPTION OF THE INVENTION

Figure 1:
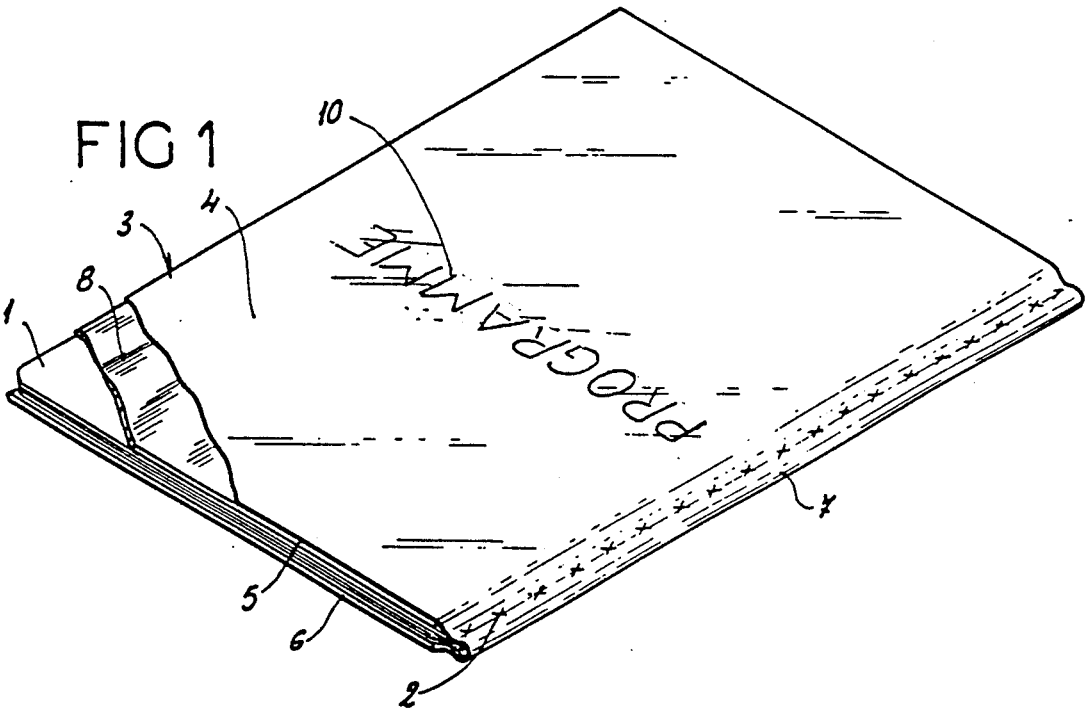
FIG. 1 is a perspective view in partial section of a book according to this process.
Figure 4:
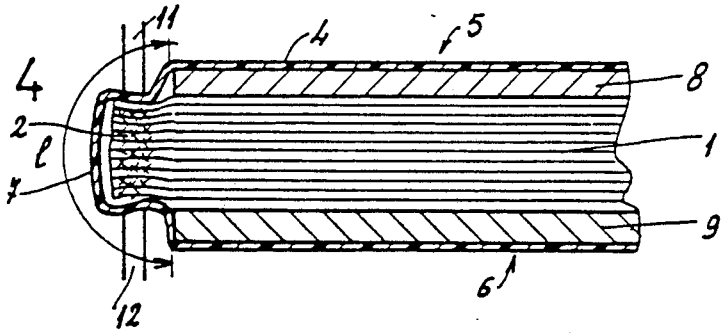
FIG. 4 is a partial cross section of the book of FIG. 1, being made.

With reference first to FIGS. 1 and 4, the book comprises a pack of transparent pockets 1, of polypropylene for example, which are heat-sealed together at 2 on one of their long ends with covering 3. This covering is made up of a double sheet 4, also of polypropylene, on whose inside are glued two sheets 8, 9 of thick, rigid cardboard to each of "flats" 5,6 of the book except for "back" 7 of the latter. Cardboard sheet 8, which provides trim for the front of the book, may carry any inscription 10.

To make the book one begins with a transparent double sheet 4 which has the dimensions of the unit of the two flats 5, 6 and back 7 of the book. On the inside or back of this sheet 4 are glued two cardboard sheets 8 and 9, taking care that inscription 10 can be seen from the outside, and leaving a space of length, on the order of a centimeter, for example, between these cardboard sheets 8, 9. Then, the cover is folded as represented in FIG. 4 and the stack of pockets 1 is introduced, by one of its large sides, into a space of length λ intended to form back 7. By pressing the unit between two electrodes 11 and 12, this large side of pockets 1 and part 7 of sheet 4 are then heat-sealed together to finally obtain the book of FIG. 1.

Figure 2:
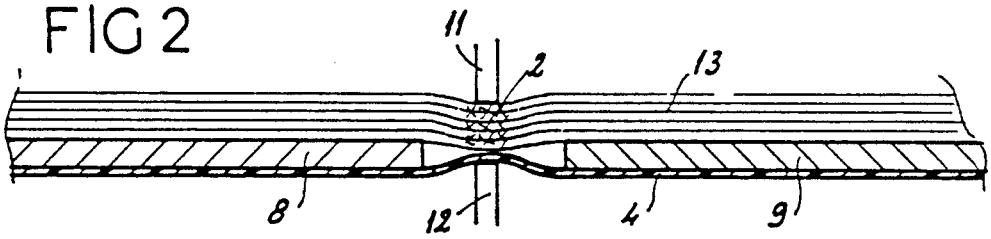
FIG. 2 is a partial cross section view of a first embodiment of the book being made.

In certain cases, in particular when the material used for making the pockets is other than polypropylene, it is possible to make the latter in the form of double pockets 13 (FIG. 2). In this case, it is easier, as shown in FIG. 2, to perform the heat-sealing that makes packages 13 and outside sheet 14 integral by leaving the book in a horizontal position during production, and by applying heat-sealing electrodes 11 and 12 on both sides of stack 13, and on the middle axis of sheet 4.

Figure 3:
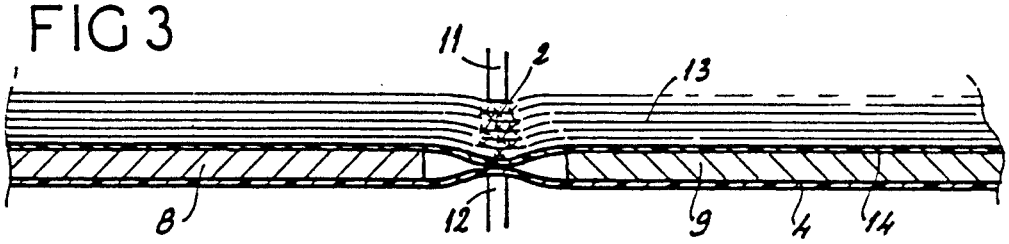
FIG. 3 is a partial cross section view of another embodiment of the book being made.

In the above, it was a question of a single transparent double sheet 4, placed on the outside (front) of the sheet of cardboard 8 and 9. It is also possible, in any case, to provide a double sheet 14 (FIG. 3) which is identical with sheet 4, glued symmetrically on the other side of these cardboard sheets 8 and 9. FIG. 3 shows such an embodiment, applied in the case of production schematized in FIG. 2. It is, of course, possible to provide an additional double sheet 14 in case of an embodiment according to FIG. 4.

The invention, of course, is not limited to the embodiments that have been described. For example, it would be possible to glue only a single sheet 8 to only one of the halves of double sheet 4, and to replace sheet 9 with a sheet of material identical with that of pockets 1 or 13, in this case, polypropylene.

The foregoing description of the specific embodiments will so reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A process for making a book having pages with a predetermined area with the pages comprising transparent pockets of a predetermined material, said process comprising:

providing a transparent cover sheet with dimensions greater than twice the size of said predetermined area with said sheet being made of said predetermined material and being divided into three zones, a front zone, a back zone and a center zone with said front and back zones having an area approximately the same as said predetermined area and said center zone being between said front and back zones and having an area smaller than said predetermined area;

gluing one of a rigid or semirigid sheet of approximately said predetermined area to one surface of said cover sheet at one of said front or back zones, gluing another of a rigid or semirigid sheet of approximately said predetermined to the other of said front or back zones on said one surface and leaving the center zone of said cover sheet free;

placing at least one transparent pocket over the cover sheet on the side of said sheet comprising said one surface; and heat sealing said at least one transparent pocket together with said center zone of said cover sheet so that the pockets and said cover are made integral by heat-sealing.

2. A book made by the process of claim 1.

3. A process for making a book having pages with a predetermined area with the pages comprising transparent pockets of a predetermined material, said process comprising:

providing a transparent cover sheet with dimensions greater than twice the size of said predetermined area with said sheet being made of said predetermined material and being divided into three zones, a front zone, a back zone and a center zone with said front and back zones having an area approximately the same as said predetermined area and said center zone being between said front and back zones and having an area smaller than said predetermined area;

gluing one of a rigid or semirigid sheet of approximately said predetermined area to one surface of said cover sheet at one of said front or back zones, gluing another of a rigid or semirigid sheet of approximately said predetermined area to the other of said front or back zones on said one surface and leaving the center zone of said cover sheet free;

placing a second transparent cover sheet of the same size as said first transparent cover sheet over the side of said one cover sheet comprising said one surface;

placing at least one transparent pocket over the second cover sheet on the free side of said second sheet; and heat sealing said at least one transparent pocket together with said center zone of said first cover sheet and with said second cover sheet so that the pockets and said cover sheets are made integral by heat-sealing.

4. A book made by the process of claim 3.

* * * * *